United States Patent [19]

Thompson

[11] Patent Number: 5,037,056

[45] Date of Patent: Aug. 6, 1991

[54] STAND-UP DESK

[76] Inventor: Wayne E. Thompson, 2448 H Rd., Grand Junction, Colo. 81505

[21] Appl. No.: 234,613

[22] Filed: Aug. 22, 1988

[51] Int. Cl.[5] ..... A47B 27/00

[52] U.S. Cl. ..... 248/441.1

[58] Field of Search ..... 248/441.1, 44; 108/1, 108/9

[56] References Cited

U.S. PATENT DOCUMENTS

| | | | |
|---|---|---|---|
| 2,176,178 | 10/1939 | Herfort | 248/441.1 |
| 2,569,716 | 10/1951 | Hawk | 108/1 |
| 2,733,970 | 2/1956 | Toney et al. | 248/441.1 |
| 2,795,891 | 6/1957 | Bishop | 108/9 |
| 2,812,614 | 11/1957 | Ladyman | 248/188.9 |
| 2,914,116 | 11/1959 | Gohmann | 108/1 |
| 3,351,402 | 11/1967 | Miller et al. | 312/233 |
| 4,553,483 | 11/1985 | Votteler et al. | 108/14 |

FOREIGN PATENT DOCUMENTS

| | | | |
|---|---|---|---|
| 513868 | 4/1954 | Belgium | 248/441.1 |
| 152734 | 5/1932 | Czechoslovakia | 248/441.1 |
| 1095751 | 6/1955 | France | 248/441.1 |
| 8622 | 4/1904 | United Kingdom | 108/1 |
| 04028 | 10/1984 | World Int. Prop. O. | 312/231 |

*Primary Examiner*—Alvin C. Chin-Shue

*Attorney, Agent, or Firm*—Donald W. Erickson

[57] ABSTRACT

A portable desk which enables a person to stand while writing. The desk is particularly useful for people who have back problems. The writing surface of the desk is inclined at an acute angle of about 40° to 50° which minimizes the stress or tension of the muscles of the person's back, shoulders and arms.

4 Claims, 1 Drawing Sheet

STAND-UP DESK

BACKGROUND OF THE INVENTION

This invention is directed at a portable stand-up desk.

People who have back ailments or back injuries generally find it ore comfortable to stand when writing or drawing. The principal object of the present invention is to provide a portable desk at which a person having a poor back can stand while writing. An additional object is to provide a portable desk for use by a person while standing which is sturdy and lightweight.

SUMMARY OF THE INVENTION

This invention is directed at a portable desk which is designed to permit a person to stand while writing. It is especially useful for a person who has an injured or ailing back. The portable desk of the present invention comprises a flat, rigid, writing surface member having a smooth top surface and a support frame for the writing surface ember, said writing surface member being inclined at an acute angle of between 40° to 50° . The portable desk is characterized by sturdiness and light weight.

DETAILED DESCRIPTION OF THE INVENTION

Figure 1:
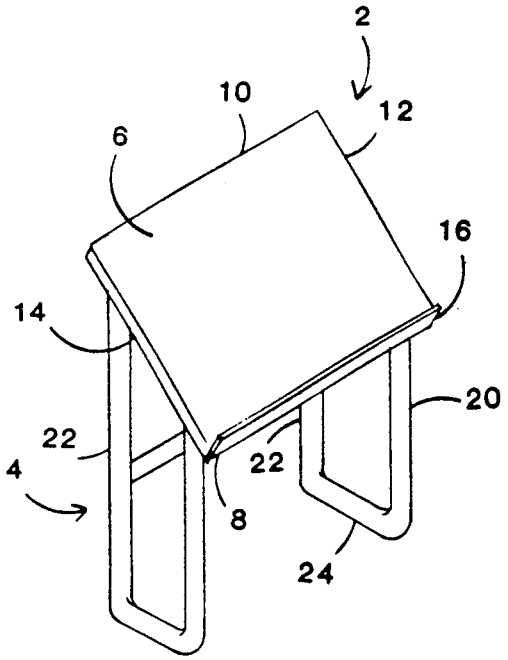
FIG. 1 is a perspective view of a portable desk of the present invention.
Figure 3:
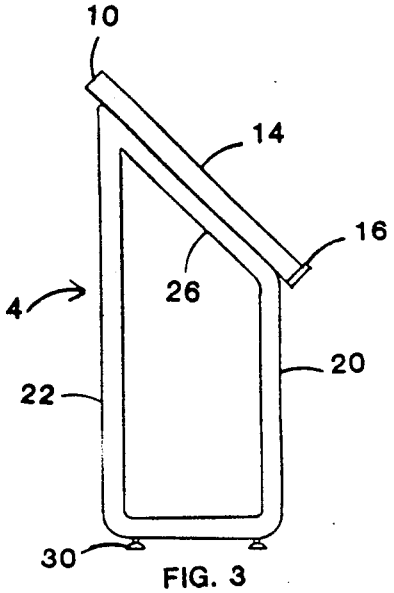
FIG. 3 is an end or side view thereof.
Figure 2:
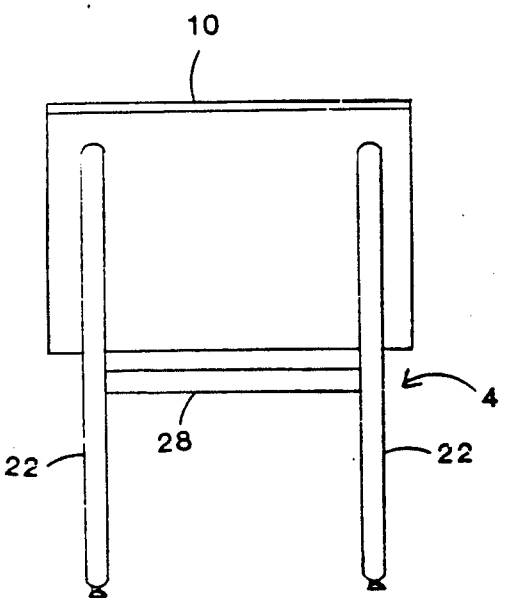
FIG. 2 is a rear view thereof.
Figure 4:
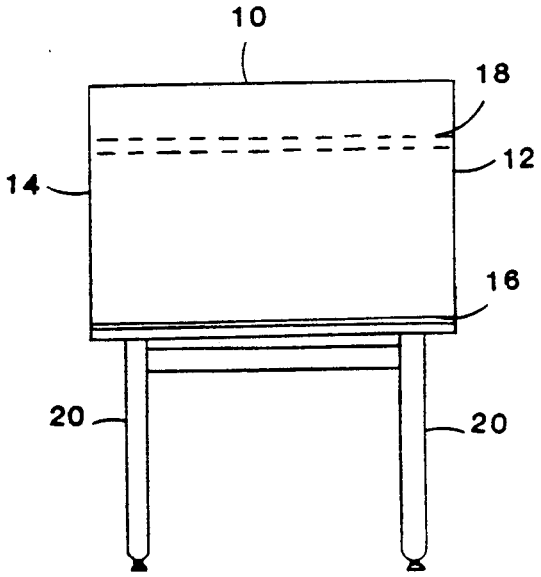
FIG. 4 is a front view thereof.

Referring to FIG. 1, the portable stand p desk of the present invention comprises a flat, rigid writing surface member 2 and a supporting frame 4. The writing surface member is provided with a smooth top surface 6 and is generally rectangular in shape as defined by parallel front and rear edges 8 and 10, respectively, and parallel side edges 12 and 14. The front edge 8 is, optionally, provided with a raised bead 16 +o prevent papers from sliding off the top surface. In lieu of or in addition to the raised bead 16, papers can be retained on the inclined top surface 6 by putting a narrow strip of magnetically responsive metal 18 (shown by broken lines in FIG. 4) in the upper portion of the writing surface and holding the paper in place through the use of small magnets. Preferably, the metal strip which may suitably be about one inch in width is embedded in the writing surface member and flush with the top surface thereof. Generally, placing the metal strip about 12 to 16 inches from the bottom edge 8 is convenient for most users. As best seen in FIG. 3, the writing surface member is inclined or slanted relative to the horizontal plane of the frame base. Preferably, the writing surface member is inclined at an acute angle of 45°, as shown in FIG. 3; however, an acute angle within the range of 40° to 50° can be used. The angle of inclination of the writing surface member is important for minimizing the stress or tension of the muscles of the person's back, shoulders and arms; particularly, the back muscles. An acute angle significantly less than 40° tends to encourage a person to hunch over or bend when writing, which is very detrimental to a person who has a back ailment. An acute angle significantly greater than 50° tends to put greater stress on the shoulder and arm muscles which tires the person prematurely. A writing surface member having sides of 18 inches and front and rear edges of 24 inches provides a good general utility desk. Smaller and larger dimensions can be used depending upon the particular use for which the desk is to be employed. In the embodiment shown, the support frame 4 comprises front and rear vertical frame members 20 and 22, respectively; a horizontal bottom frame member 24 joining the vertical members 20 and 22 at the base thereof; a slanted top frame ember 26 which is inclined at the same angle as the writing surface member, said top frame joining the vertical members 20 and 22 at the top thereof; and a horizontal frame ember 28 joining the rear vertical embers. The horizontal frame ember 28 can suitably be positioned at about midpoint of the height of the rear vertical frame embers 22. Optionally, a horizontal frame member like 28 can be used to join the front vertical members 20 to further ensure stability of the desk. In the embodiment shown, the rear vertical members 22 and the front vertical members 20 have a height of about 25 and 15 inches, respectively. The support frame described provides a very sturdy and stable desk which is an important feature for the user who has a back ailment. It is possible for the standing person to grasp the desk and lean on it without fear of it collapsing. The writing surface member can =securely attached to the slanted top frame member and in immediate contact therewith as by screws, inlaid or embedded bolts or screwed or bolted U-brackets. Optionally, there can be provided adhering means such as suction cups 30 to the underside of horizontal bottom frame member 24 to inhibit slippage of the desk The support frame as shown is constructed of cylindrical tubular steel of one-half inch O.D. The support frame is not limited to the cylindrical tubular steel shown. The support frame can be constructed of rigid plastic, wood, or metal that is hollow or solid and cylindrical or rectangular in shape. In addition, the horizontal frame member 24 joining vertical members 20 and 22 need not be positioned at the very bottom. It can be positioned at about midpoint or lower of the height of the vertical members without significant loss of lateral stability. The support frame as shown is the preferred embodiment because of its stability and the absence of either vertical or lateral flexing which is very important to a person who has back problems. However, other support systems can be devised without departing from the scope and spirit of the invention. For example, a stable support frame can =constructed using four vertical support members such as front and rear vertical members 20 and 22 and positioned substantially as shown in FIG. 1. Rigidity and stability of the frame can be imparted by attaching the top of vertical members 20 and 22 to the underside of writing surface 2 by using a generally flat bracket or plate which is firmly attached to said underside surface.

The writing surface member 2 is constructed of a flat, rigid material. Materials of plastic, wood, metal or combination thereof can be used. It needs to be of sufficient rigidity and strength so that it does not flex significantly and does not give or break if the user leans on the desk. In the embodiment shown, a one-half inch composite board with an formica top surface was used. In addition to composite board, or wood, there can used plywood, waferboard, plastics such as a rigid nylon, Lucite, Lexan or Plexiglas, and metals such as cast aluminum.

The stand-up desk of the present invention is portable and designed for u==by positioning on a supporting surface such as a table, counter or other surface which provides a comfortable position while the user is standing. It provides a convenient and effective means for persons troubled with a back ailment to be able to stand and write without the discomfort associated with the person in the seated position.

What is claimed is:

1. A portable desk designed for use by positioning it on a supporting surface such as a table, counter or other surface and thereby providing a comfortable position while the user is standing comprising:

a flat, rigid writing surface member which is generally rectangular in shape as defined by parallel front and rear edges and parallel sides edges, said writing surface member having a smooth top surface and being inclined at an acute angle of about 40 to 50 degrees relative to said front edge and a support frame for said writing surface member comprising two front vertical frame members and two rear vertical frame members, said vertical frame members being positioned near the juncture of the front and side edges and the juncture of the rear and side edges, a horizontal side frame member joining a front and rear vertical frame member at or near the bottom of the vertical members at each side of the desk, a slanted top frame member which is inclined at the same angle as the writing surface member, said top frame member joining a front and rear vertical member at the top thereof at each side of the desk, said top frame member being securely attached to the under side of the writing surface member, and a rear horizontal frame member joining the two vertical frame members, said desk being characterized by being lightweight, rigid and the absence of vertical or lateral flexing.

2. The desk according to claim 1 wherein the writing surface member is inclined at an acute angle of about 45 degrees.

3. The desk according to claim 1 wherein said rear horizontal member is positioned at about midpoint of the height of the vertical members.

4. The desk according to claim 1 wherein said horizontal side members join the vertical members at the bottom thereof.

* * * * *